US009660371B2

(12) United States Patent
Konno

(10) Patent No.: US 9,660,371 B2
(45) Date of Patent: May 23, 2017

(54) CONDUCTIVE CONNECTOR

(71) Applicant: POLYMATECH JAPAN CO., LTD., Saitama (JP)

(72) Inventor: Hideaki Konno, Saitama (JP)

(73) Assignee: POLYMATECH JAPAN CO., LTD., Saitama (JP)

( * ) Notice: Subject to any disclaimer, the term of this patent is extended or adjusted under 35 U.S.C. 154(b) by 0 days.

(21) Appl. No.: 14/896,431

(22) PCT Filed: Jul. 18, 2014

(86) PCT No.: PCT/JP2014/069208
§ 371 (c)(1),
(2) Date: Dec. 7, 2015

(87) PCT Pub. No.: WO2015/025660
PCT Pub. Date: Feb. 26, 2015

(65) Prior Publication Data

US 2016/0126655 A1 May 5, 2016

(30) Foreign Application Priority Data

Aug. 19, 2013 (JP) ..... 2013-169466

(51) Int. Cl.
*H01R 4/58* (2006.01)
*H01R 13/24* (2006.01)
(Continued)

(52) U.S. Cl.
CPC ..... *H01R 13/2414* (2013.01); *H01R 4/64* (2013.01); *H01R 4/58* (2013.01); *H01R 11/01* (2013.01)

(58) Field of Classification Search
CPC . H01R 11/01; H01R 4/58; H01R 4/64; H01R 13/2414
(Continued)

(56) References Cited

U.S. PATENT DOCUMENTS 5,819,406 A * 10/1998 Yoshizawa ..... H05K 3/325 156/295
6,280,202 B1 * 8/2001 Alden, III ..... H05K 7/142 174/138 D
(Continued)

FOREIGN PATENT DOCUMENTS

JP 2005-038759 A 2/2005
JP 2007-141533 A 6/2007
JP 2009-048897 A 3/2009

OTHER PUBLICATIONS

International Search Report for PCT Patent App. No. PCT/JP2014/069208 (Oct. 14, 2014).

*Primary Examiner* — Abdullah Riyami
*Assistant Examiner* — Nelson R Burgos-Guntin
(74) *Attorney, Agent, or Firm* — Cermak Nakajima & McGowan LLP; Tomoko Nakajima

(57) ABSTRACT

In a connector including a connection portion that is compressed between connection object members (F and F') and that conductively connects the connection object members (F and F') to each other, and a base portion that is connected to the connection portion and that forms a recess therein, the connection portion includes a plurality of conductive portions, each conductive portion having conductors arranged in a thickness direction and two electrode planes each in contact with the corresponding one of the connection object members (F and F'), and a retaining portion that retains the conductive portion, the base portion including erect walls and a top wall portion so as to form a recess in the erect walls and the top wall portion, the base portion including, in the recess, partition walls so as to form accommodation portions that accommodate projecting parts (S) connected to the connection object member (F').

10 Claims, 6 Drawing Sheets

(51) Int. Cl.
*H01R 4/64* (2006.01)
*H01R 11/01* (2006.01)

(58) Field of Classification Search
USPC ..... 439/83, 91, 591
See application file for complete search history.

(56) References Cited

U.S. PATENT DOCUMENTS

| | | | | |
|---|---|---|---|---|
| 6,841,882 | B2 * | 1/2005 | Chien | H01L 23/49827 257/777 |
| 7,618,267 | B2 | 11/2009 | Konno et al. | |
| 7,887,336 | B2 * | 2/2011 | Nikaido | H01L 23/49827 439/591 |
| 8,033,835 | B2 * | 10/2011 | Mulfinger | H05K 7/1407 439/591 |
| 8,334,595 | B2 * | 12/2012 | Jung | G01R 1/06761 257/48 |
| 2009/0053907 | A1 | 2/2009 | Konno et al. | |
| 2015/0364848 | A1 * | 12/2015 | Limb | H01R 13/2414 310/363 |
| 2016/0126655 | A1 * | 5/2016 | Konno | H01R 13/2414 439/86 |

* cited by examiner

CONDUCTIVE CONNECTOR

This application is a national phase entry under 35 U.S.C. §371 of PCT Patent Application No. PCT/JP2014/069208, filed on Jul. 18, 2014, which claims priority under 35 U.S.C. §119 to Japanese Patent Application No. 2013-169466, filed Aug. 19, 2013, both of which are incorporated by reference.

TECHNICAL FIELD

The present invention relates to a connector that performs conductive connection inside an electronic device or the like.

BACKGROUND ART

A conductive-rubber connector has been used to conductively connect a circuit substrate and an electronic component to each other inside an electronic device. As such rubber connectors, a rubber connector that is formed of conductive rubber in its entirely and a rubber connector including a conductive portion in which conductive particles are oriented inside an insulating rubber are known. Japanese Unexamined Patent Application Publication No. 2009-048897 describes a connector including a plurality of conductive portions.

CITATION LIST

Patent Literature

PTL 1: Japanese Unexamined Patent Application Publication No. 2009-048897

SUMMARY OF INVENTION

Technical Problem

In the case of a connector described in Japanese Unexamined Patent Application Publication No. 2009-048897, which includes conductive portions having conductive particles oriented inside an insulating rubber, since the plurality of conductive portions are included, the area subject to connection has no choice but to become large and an accordingly large and uniform flat surface is required. However, due to miniaturization of electronic devices and diversification in design, while there is no space inside the electronic device to provide a flat uniform surface with a large area, reliable conductive connection in a small space is in need.

Accordingly, an object of the present invention is to provide a connector that is capable of reliably performing conductive connection even in a portion where there is no space.

Solution to Problem

In order to achieve the above object, provided is a connector including a connection portion that is compressed between connection object members and that conductively connects the connection object members to each other, and a base portion that is connected to the connection portion and that forms a recess therein. In the connector, the connection portion includes a plurality of conductive portions, each conductive portion having conductors arranged in a thickness direction and having two electrode planes each in contact with the corresponding connection object member, and a retaining portion that retains the conductive portion, the base portion includes an erect wall and a top wall portion so as to form a recess in the erect wall and the top wall portion, the base portion includes, in the recess, a parts corresponding surface that extends along a projecting part connected to the corresponding connection object member so as to form an accommodation portion that accommodates the projecting part, and the electrode planes are each an inclination/bend corresponding surface that is inclined or bent along a shape of a connection surface of the corresponding connection object member.

Furthermore, provided is a connector that is compressed between connection object members and that conductively connects the connection object members to each other, the connector including a plurality of conductive portions, each conductive portion having conductors arranged in a thickness direction and having two electrode planes each in contact with the corresponding connection object member, and a retaining portion that retains the conductive portion. In the connector, the electrode planes are each an inclination/bend corresponding surface that is inclined or bent along a shape of a connection surface of the corresponding connection object member.

Since the electrode planes are each an inclination/bend corresponding surface that is inclined or bent along the shape of the connection surface of the corresponding connection object member, a maximum contact area between the electrode planes and the connection surfaces of the connection object members can be obtained. Furthermore, since a large contact area can be obtained without an application of an excessive compressing load to the electrode planes, the conductive connection can be performed reliably.

Note that the inclination/bend corresponding surface refers to a surface that coincides with the surface corresponding to the shape of the contact surface of the corresponding connection object member.

The connector may be a connector in which the conductive portions protrude from the retaining portion in the thickness direction. Since the conductive portions protrude from the retaining portion in the thickness direction, the conductive portions can be connected to the corresponding connection object member in a reliable manner.

A surface of the retaining portion may be an inclination/bend corresponding surface that is inclined or bent along a shape of a connection surface of the corresponding connection object member that is to be connected. Since the surface of the retaining portion is the inclination/bend corresponding surface that is inclined or bent along the shape of the connection surface of the corresponding connection object member that is to be connected, it is possible to prevent a portion of the retaining portion to excessively be in contact with the connection object member even when the retaining portion comes in contact with the connection object member together with the conductive portion. Accordingly, it is possible to prevent the conductive portions from having no load being applied thereto or to prevent the conductive portions from being applied with a load that is more than required.

Since the connector includes the connection portion that is compressed between the connection object members and that conductively connects the connection object members to each other, and the base portion that is connected to the connection portion and that forms a recess therein, the conductive connection between the connection object members can be assumed by the connection portion and the pressing force from the connection object members can be assumed mainly by the base portion.

Since the connection portion includes the plurality of conductive portions, each conductive portion having the conductors arranged in the thickness direction and the two electrode planes each in contact with the corresponding connection object member, and the retaining portion that retains the conductive portion, the connector function that achieves conduction in one direction can be performed by the connection portion.

Since the base portion includes the erect wall and the top wall portion so as to form the recess in the erect wall and the top wall portion, the base portion can be prevented from becoming thick and a large load when pressing the connector can be prevented from being applied to the connection object members. Furthermore, the pressing load transmitted from the connection object members can be received by the base portion that is a different component with respect to the connection portion. Accordingly, a reliable conductive connection that makes excessive load to not easily be transmitted to the connection portion and that eliminates bending and deformation caused by excessive load on the connection portion can be achieved.

Furthermore, since the recess includes the parts corresponding surface so as to form the accommodation portion that accommodates the projecting part connected to a connection object member, the screw and the like that is included in the connection object member can be accommodated therein and the connector can be disposed while the accommodation portion is positioned at the screw position. Furthermore, while forming the accommodation portion inside the recess, a recess that does not serve as an accommodation portion can be provided. Accordingly, the function obtained by having the recess can be exerted without losing the function.

In the connector, a thickness of the base portion may be thicker than a thickness of the connection portion. Since the thickness of the base portion is thicker than the thickness of the connection portion, the pressing load transmitted from the connection object member can be received mainly by the base portion. Accordingly, no excessive pressing load is applied to the connection portion and an appropriate contact between the electrode planes and the connection object members can be achieved.

A surface of the top wall portion may be an inclination/bend corresponding surface that is inclined or bent along a shape of a connection surface of the corresponding connection object member that is to be connected. Since the surface of the top wall portion is the inclination/bend corresponding surface that is inclined or bent along the shape of the connection surface of the corresponding connection object member that is to be connected, the pressing force from the connection object member can be received with the entire base portion in a uniform manner. Accordingly, a portion of the base portion receiving an excessive pressing force can be prevented and, consequently, an appropriate connection between the connection portion and the connection object members can be achieved.

The connector may be a connector in which the electrode planes on the same surface side of the plurality of conductive portions are disposed on an inclination or a bent surface that continuously extends along an inclination or a bent surface shape of a connection surface of the corresponding connection object member. Since the electrode planes on the same surface side of the plurality of conductive portions are disposed on the inclination or the bent surface that continuously extend along the inclined shape or the bent surface shape of the connection surface of the corresponding connection object member, the plurality of electrode planes of the plurality of conductive portions can be in contact with the connection object member in an appropriate manner and conductive connection can be performed in a reliable manner.

Advantageous Effects of Invention

The connector of the present invention is capable of performing conductive connection with the connection object members in a stable and reliable manner. Furthermore, the connector can be disposed in a region with a small space and conductive connection can be reliably achieved with a small load.

DESCRIPTION OF EMBODIMENTS

Figure 1:
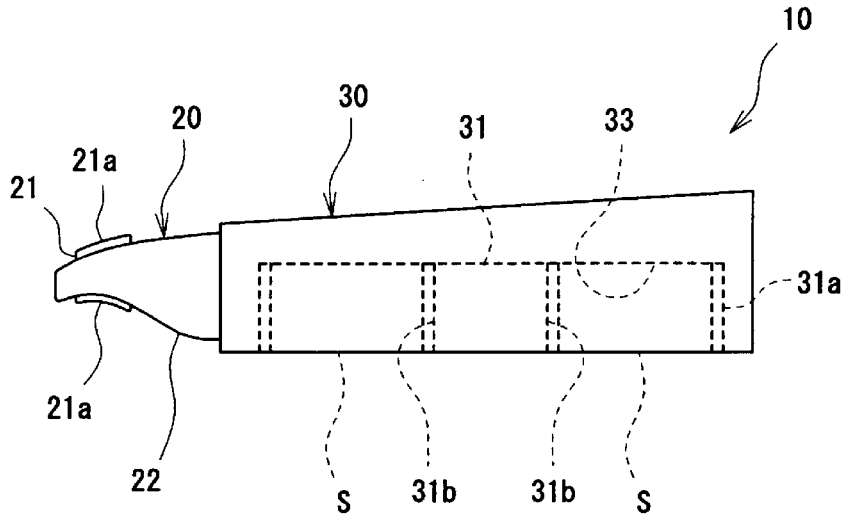
FIG. 1 is a front view of a connector of a first embodiment.

The present invention will be described in further detail with reference to the embodiments. Components that are common among each embodiment will be attached with the same reference numerals and redundant description thereof will be omitted. Furthermore, redundant descriptions of common materials, manufacturing methods, effects, and the like will also be omitted.

First Embodiment [FIG. 1 to FIG. 4]

Figure 2:
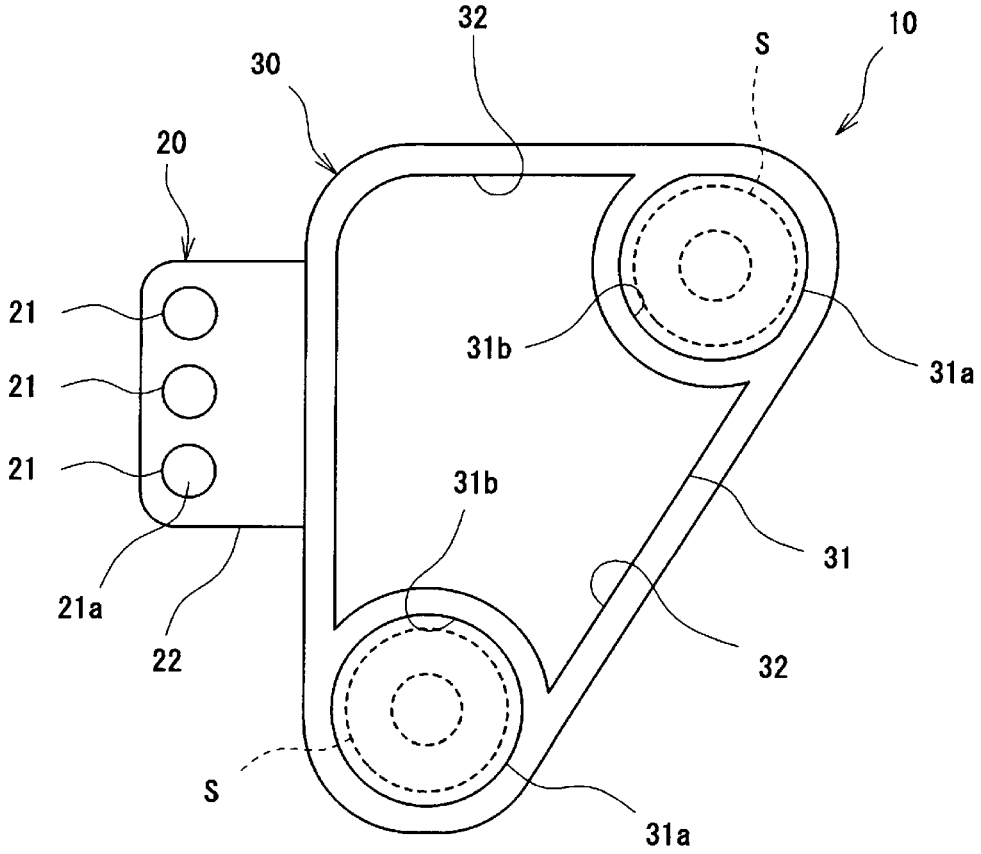
FIG. 2 is a rear view of the connector in FIG. 1.
Figure 3:
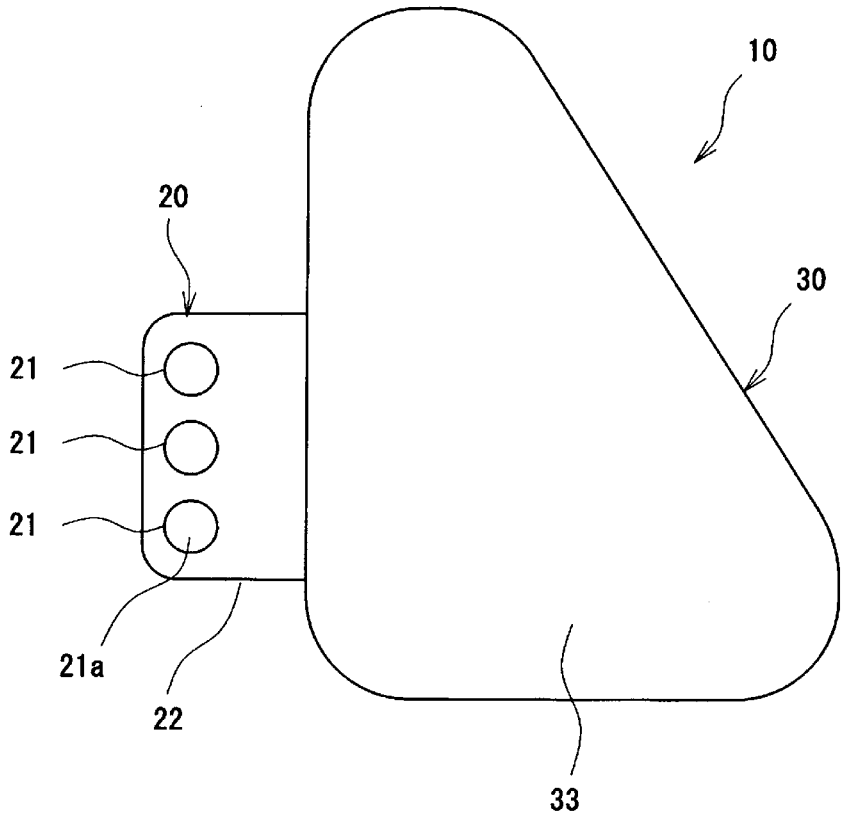
FIG. 3 is a plan view of the connector in FIG. 1.

A front view of a connector 10 of the present embodiment is described in FIG. 1, a rear view in FIG. 2, and a plan view in FIG. 3. As illustrated in FIG. 1, the connector 10 includes a connection portion 20 that conductively connects connection object members to each other, and a base portion 30 that is connected to the connection portion 20 and that forms a recess 31 therein.

The connection portion 20 includes a conductive portion 21 that has conductivity and a retaining portion 22 that has insulation properties. As illustrated in FIGS. 2 and 3, in the present embodiment, three conductive portions 21 are formed. In each conductive portion 21, conductors are arranged in the thickness direction and two electrode planes 21*a* and 21*a* protrude out from the retaining portion 22 that retains the conductive portion 21. The electrode planes 21*a* and 21*a* have inclination/bend corresponding surfaces that have been inclined or bent along the shapes of the contact surfaces of the connection object members F and F' that are to be connected.

The base portion 30 includes erect walls 32 and a top wall portion 33, and the recess 31 is formed inside a portion surrounded by the erect walls 32 and the top wall portion 33. Furthermore, in the recess 31, partition walls that partition the inside of the recess 31 so as to suitably accommodate projecting parts, for example, screws S, that are connected to the connection object member F' are provided such that parts corresponding surfaces 31*b* are formed. Furthermore, accommodation portions 31*a* are formed along the external form of the screws S to suitably accommodate the screws S.

A thickness (a height) of the base portion 30 is formed so as to be thicker (taller) than a thickness of the retaining portion 22 and a thickness of the conductive portion 21 of the connection portion 20. Furthermore, a surface of the top wall portion 33 is an inclined surface inclined towards the opposite side with respect to the connection portion with the connection portion 20 and is an inclination/bend corresponding surface extending along the surface form of the connection object member F.

An exemplary method of manufacturing the connector 10 includes a method of forming the connector 10 by pouring a raw material liquid, which is liquid rubber in which magnetic and conductive particles are dispersed, into a mold in which magnetic pins are arranged, and by curing the liquid rubber after magnetically orienting the magnetic and conductive particles. In other words, it is desirable that the conductive portions 21 are formed at portions corresponding to the magnetic pins by orienting the magnetic and conductive particles and that the retaining portion 22 is formed at portions other than the above as a portion in which the liquid rubber is cured. The method of magnetically orienting magnetic and conductive particles in liquid rubber is desirable since the method is capable of increasing conductivity with a small amount of conductors and, furthermore, is capable of forming a soft conductive portion 21. Furthermore, it is also desirable since thin and small conductive portions 21 can be formed easily.

The conductor includes, for example, particles of a ferromagnetic metal, such as nickel, cobalt, or iron, or an alloy including the ferromagnetic metals. Other than the above, particles in which a ferromagnetic metal, such as nickel, cobalt, iron, or ferrite, is coated with metal with good conductivity or conductive or insulating particles whose surfaces are coated with nickel, cobalt, iron, or the like may be used. Among the above, the particles in which a ferromagnetic material is coated with metal with good conductivity are desirable. As for the metal with good conductivity, metal, such as gold, silver, platinum, aluminum, copper, palladium, or chrome; an alloy, such as stainless steel; resin, insulating ceramic, or the like that has been plated with a magnetic conductor; or a magnetic conductor that has been plated with metal having good conductivity may be used. Each conductor may have a particulate shape, a fibrous shape, a thin wire shape, or a scaly shape.

Surface treatment may be applied to the surface of the conductor in order to increase adhesiveness between the conductor and the rubbery elastic body. For example, the surface of the conductor may be treated with a coupling agent such as a silane coupling agent. Specific methods include a method (wet process, dry process) in which dispersion treatment of the coupling agent to the conductors is performed in advance and a method (integral blending method) in which a coupling agent is added when mixing the rubbery elastic body and the conductors together.

A curing-type or a melting-type rubbery elastic body may be used as the liquid rubber. For example, the above includes natural rubber, silicone rubber, isoprene rubber, butadiene rubber, acrylonitrile-butadiene rubber, 1,2-polybutadiene, styrene-butadiene rubber, chloroprene rubber, nitrile rubber, isobutylene-isoprene rubber, ethylene-propylene rubber, chlorosulfonated rubber, polyethylene rubber, acrylic rubber, epichlorohydrin rubber, fluororubber, urethane rubber, styrenic thermoplastic elastomer, olefin-based thermoplastic elastomer, ester-based thermoplastic elastomer, urethane-based thermoplastic elastomer, amide-based thermoplastic elastomer, vinyl chloride-based thermoplastic elastomer, fluorine thermoplastic elastomer, and ion-cross-linked thermoplastic elastomer.

The viscosity of the raw material liquid, which is liquid rubber in which conductive particles are dispersed, during forming needs to be at a viscosity that allows the contained conductive particles to flow with the magnetic field, and is preferably from 1 Pa·s to 250 Pa·s and more preferably from 10 Pa·s to 100 Pa·s.

Figure 4:
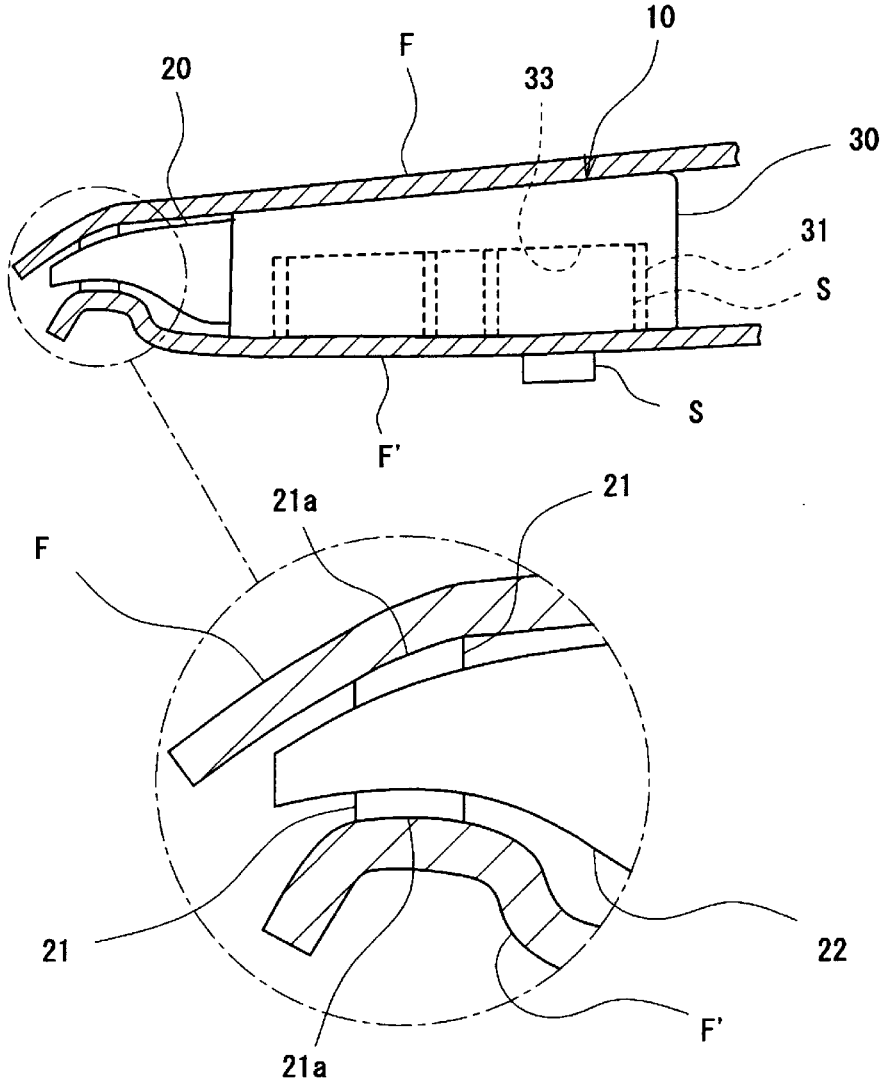
FIG. 4 is a schematic diagram illustrating the connector in FIG. 1 while in use.

The connector 10 is used while being compressed between the two connection object members F and F' and conductively connects the two connection object members F and F' to each other. In FIG. 4, the connector 10 is pinched between an aluminum housing F of a portable electronic device and a metal plate F' located inside the portable electronic device. Other than the above example, the connection object members F and F' may each be a housing (a device case) of a portable electronic device, a housing and a metal plate provided inside an electronic device, a housing and a circuit substrate, or the like.

To attach the connector 10 inside the portable electronic device, the accommodation portions 31*a* of the connector 10 is covered over the screws S attached to the metal plate F' such that positioning is performed to install the connector 11, and by closing the housing F to compress and retain the base portion 30 of the connector 10 with the housing F and the metal plate F'. At this moment, the conductive portions 21 are also pinched between the housing F and the metal plate F' as well.

Since the surface of the top wall portion 33 that forms the base portion 30 is formed as an inclination/bend corresponding surface that is inclined or bent along the surface shape of the housing F, the pressing force when pinched between the connection object members F and F' can be received by the base portion 30. Furthermore, since the base portion 30 is formed higher than the height of the connection portion 20, the main pressing force is applied to the base portion 30 and an excessively large pressing force is not easily applied to the connection portion 20. Accordingly, the connector 10 is compressed and pinched at the base portion 30 and a load that is as large as that received by the base portion 30 is not applied to the connection portion 20. Accordingly, the conductive portion 21 is not bent, or smashed intensely.

Since the electrode planes 21*a* and 21*a* of the conductive portions 21 are each formed in a shape that extends along the connection surface shape of the corresponding one of the housing F and the metal plate F' to which the electrode planes 21*a* and 21*a* come in contact, even if no large load is applied to the conductive portions 21, the conductive portions 21, and the housing F and the metal plate F' can be connected in a fine manner. Furthermore, the surface shape of the retaining portion 22 is also an inclination/bend corresponding surface that has a shape extending along the surface shapes of the connection object members. If the retaining portion 22 has a shape that projects out, there are cases in which the portion that projects out receives excessive pressing force from the connection object members and the connection portion 20 is deformed causing a connection impediment at the conductive portions 21; however, since the retaining portion 22 is also an inclination/bend corresponding surface, such a connection impediment do not occur.

Since the base portion 30 is provided with the large recess 31 with the thin erect walls 32 and the top wall portion 33 such that the entire base portion 30 has a recessed shape, the base portion 30 itself can be made light in weight.

Furthermore, since in the recess 31 provided in the base portion 30, the parts corresponding surfaces 31*b* are provided with the partition walls to form the accommodation portions 31*a*, the accommodation portions 31*a* can be formed in shapes that correspond to the screws S that are provided in the metal plate F' and positioning of the connector 10 can be carried out with the accommodation portions 31*a*. Accordingly, the inclinations or the bent surfaces of the electrode planes 21*a* and the connection object members F and F' can be accurately matched to each other. In the present embodiment, by providing the partition walls that form the parts corresponding surfaces 31*b* inside the recess 31 in the base portion 30 having a triangular shape, it is suitable to perform positioning when the arrangement direction of the two screws S are different with respect to the arrangement direction of three conductive portions 31.

Furthermore, with the formation of the recess 31, a space portion that is not involved in the accommodation of the screws S exists; accordingly, the connector 10 can be made lighter in weight and application of an excess reaction force to the connection object members F and F' can be prevented when pressing the connector 10.

Exemplary Modifications of Embodiment [FIG. 5 to FIG. 11]

The two electrode planes 21*a* and 21*a* may have different shapes in the upper and lower portions of the conductive portions 21 and, further, may be sterically rugged surfaces such as a combination of inclined surfaces having different inclinations.

Figure 5:
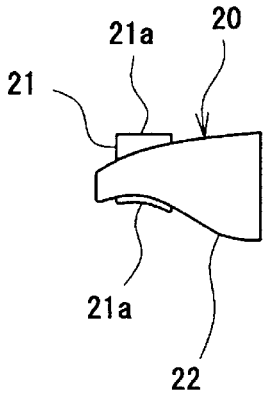
FIG. 5 is a partially enlarged front view of a connector of another embodiment.
Figure 6:
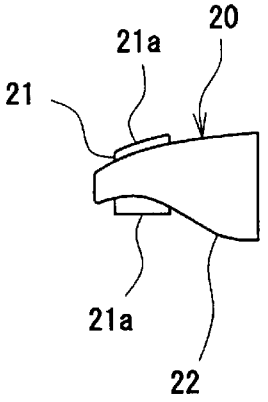
FIG. 6 is a partially enlarged front view of a connector of still another embodiment.

FIGS. 5 and 6 illustrates examples in which, among the two electrode planes 21*a* and 21*a* included in a single conductive portion 21, either one of the electrode planes 21*a* and 21*a* is not an inclination/bend corresponding surface but is formed as a conventional electrode plane that has a vertical surface with respect to the conduction direction. In the above examples, in FIG. 5, only the connector on the lower side of the drawing is the connector that is an inclination/bend corresponding surface and, in FIG. 6, only the connector on the upper side of the drawing is an inclination/bend corresponding surface.

As illustrated in the present embodiment, only either one of the electrode planes 21*a* can be an inclination/bend corresponding surface; however, it is desirable that both surfaces of the electrode planes 21*a* and 21*a* are inclination/bend corresponding surfaces.

Figure 7:
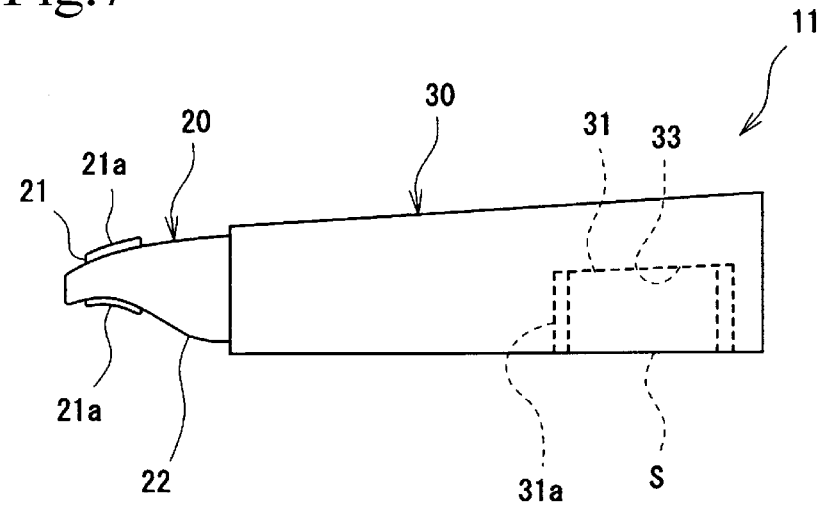
FIG. 7 is a front view of a connector of yet another embodiment.
Figure 8:
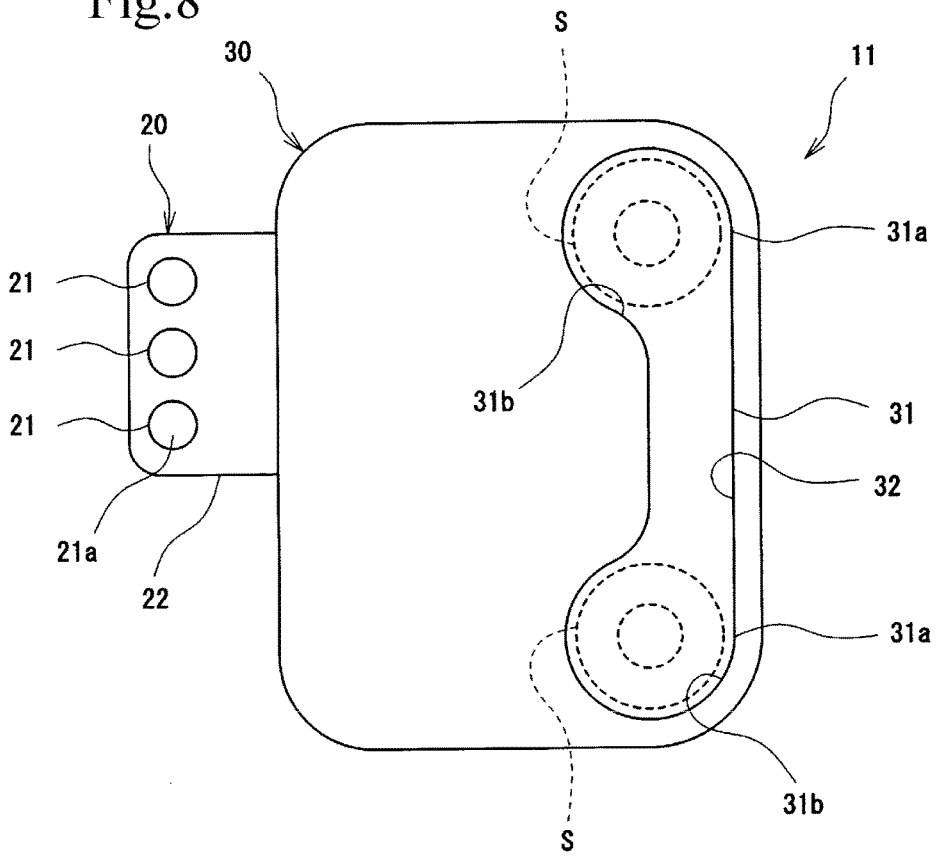
FIG. 8 is a rear view of the connector in FIG. 7.

The positions and the shapes of the recess 31 and the parts corresponding surfaces 31*b* may be changed according to the disposition and the like of the screws S provided in the connection object member. FIGS. 7 and 8 illustrates an exemplary modification of the shape of the recess 31 formed in the base portion 30 and of the parts corresponding surfaces 31*b* in a case in which the arrangement direction of the two screws S are the same as the arrangement direction of the three conductive portions 21. Compared with the connector 10 illustrated in FIGS. 1 and 2, connector 11 above is provided with a thick portion in the base portion 30 on the connection portion 20 side. Accordingly, even in a case in which a large force is applied from the connection object members, the base portion 30 buffers the force and is capable of preventing a load that is more than required to be applied to the connection portion 20 such that deformation and tearing of the connection portion 20 can be prevented.

Furthermore, the electrode planes 21*a* and 21*a* of the conductive portions 21 each have a shape that corresponds to the surface of the connection object member F or F' that is the object of connection, and various modifications can be made. For example, when the connection object members F and F' have convex surfaces such as a spherical surface or a columnar lateral side, the electrode planes 21*a* may be formed so as to have concave surfaces that are recessed along the convex surfaces. Conversely, when the connection object members F and F' have concave surfaces, the electrode planes 21*a* may be formed so as to have convex surfaces that protrude along the concave surfaces. As described above, the electrode planes 21*a* may have various shapes such as a flat surfaced shape, a concave or convex shape, a spherical or a columnar shape, and, furthermore, tilted shapes of the above.

Figure 9:
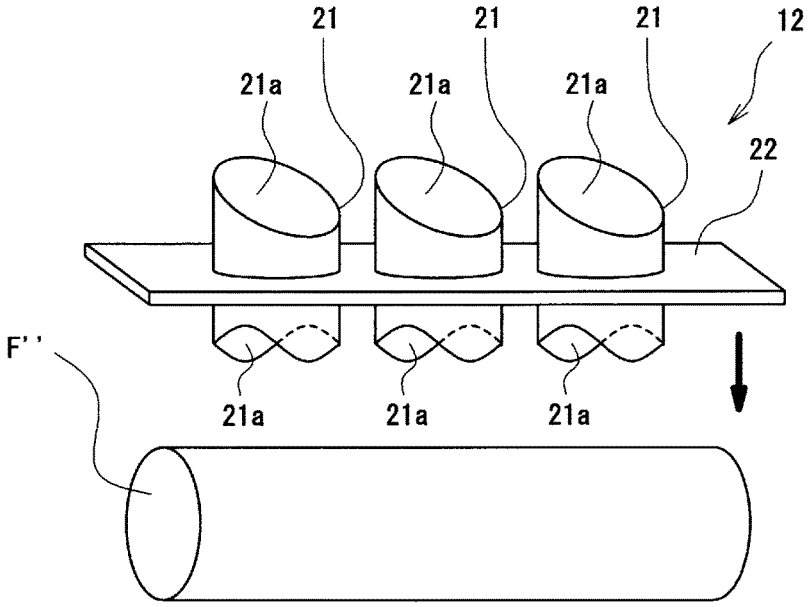
FIG. 9 is a schematic diagram of a connector that is connected to a columnar connection object member.
Figure 10:
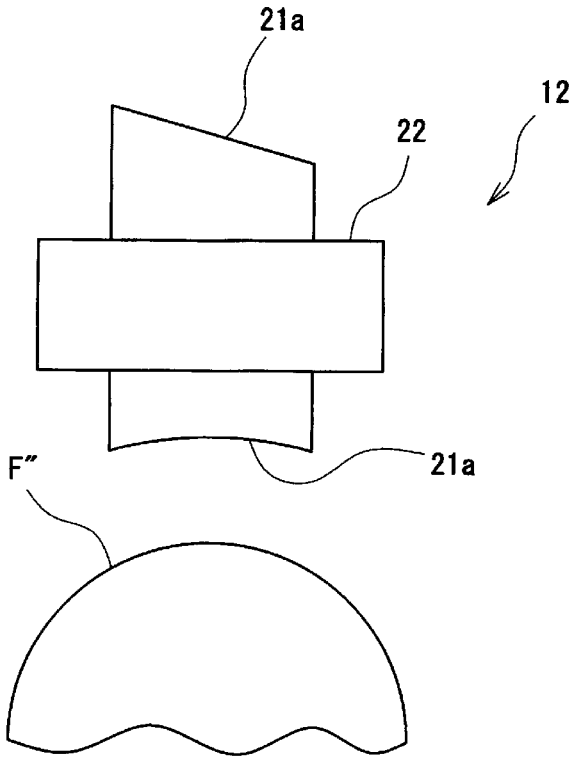
FIG. 10 is a schematic diagram of FIG. 9 viewed from the left side.

In FIG. 9, as another embodiment, a connector 12 including three conductive portions 21 that have peripheral surfaces that come in contact with a connection object member F" having a columnar shape is illustrated schematically (the base portion is omitted). Furthermore, FIG. 10 illustrates a schematic diagram viewed from the left side of the connector 12. The electrode planes 21*a* on the lower side of the drawing have arc shapes that correspond to the peripheral surface of the columnar connection object member F". Meanwhile, the electrode planes 21*a* on the upper side of the drawing are inclined surfaces that are inclined from this side of the drawing to that side and the three inclined surfaces of the three conductive portions 21 exist on a single plane that is inclined upwards from this side of the drawing to that side.

Figure 11:
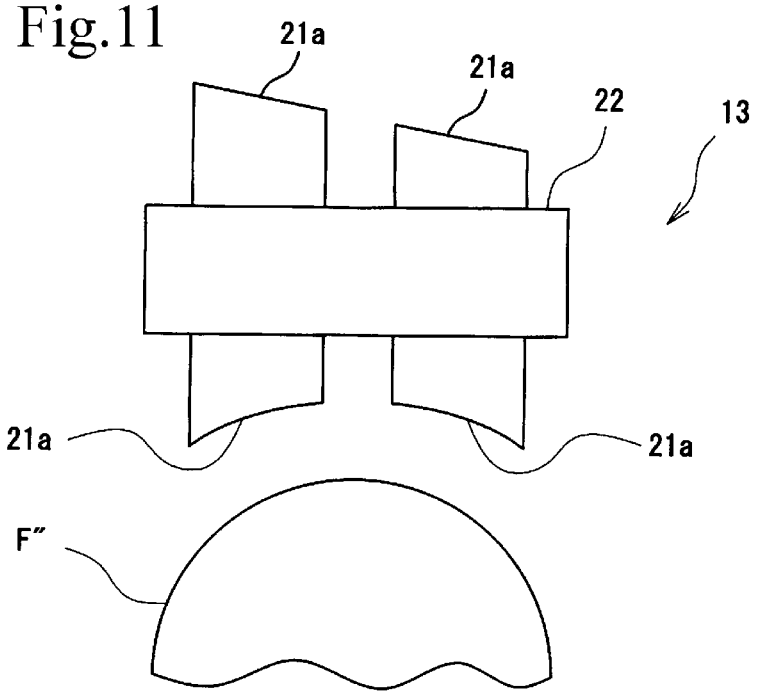
FIG. 11 is a schematic diagram, corresponding to FIG. 10, of a connector including six conductive portions.

FIG. 11, which corresponds to FIG. 10, is a left side view of a connector 13 provided with six conductive portions 21. Regarding the electrode planes 21*a* on the lower side of the drawing, both the electrode planes 21*a* on the left side and the right side of the drawing have shapes that extend along the surface shape of the connection object member F".

Various conductive portions 21 as above can be obtained by die forming, and even if the orientations and the shapes of the electrode planes 21*a* are complex, connectors 10 having conductive portions 21 with the same shape can be mass produced. Note that although the connector may be integrally formed with the retaining portion by insert molding conductive portions that are formed of conductive rubber, since it is difficult to accurately match the orientation of the plurality of electrode planes, die forming is more desirable.

Modification may be made to each of the components described in the embodiments described above without departing from the scope of the present invention and, for example, the components described in the other embodiments may be applied after performing appropriate modification and combining some of the components with each other. Furthermore, the above modifications and combinations are within the range of the technical idea of the present invention. It goes without saying that the shape of the conductive portion 21 may not be columnar shape but may be a prismatic shape.

REFERENCE SIGNS LIST

10,11,12,13 connector
20 connection portion

21 conductive portion
21*a* electrode plane
22 retaining portion
30 base portion
31 recess
31*a* accommodation portion
31*b* parts corresponding surface
32 erect wall
33 top wall portion
S screw
F,F',F" connection object member

The invention claimed is:

1. A connector, comprising:
a connection portion that is compressed between connection object members and that conductively connects the connection object members to each other; and
a base portion that is connected to the connection portion and that forms a recess therein, wherein
the connection portion includes
a plurality of conductive portions, each conductive portion having conductors arranged in a thickness direction and having two electrode planes each in contact with the corresponding connection object member, and
a retaining portion that retains the conductive portion,
the base portion includes an erect wall and a top wall portion so as to form a recess in the erect wall and the top wall portion,
the base portion includes, in the recess, a parts corresponding surface that extends along a projecting part connected to the corresponding connection object member so as to form an accommodation portion that accommodates the projecting part, and
each of the electrode planes having an inclination/bend surface corresponding to a shape of a connection surface of the corresponding connection object member in a free state from the connection object members.

2. The connector according to claim 1, wherein
a thickness of the base portion is thicker than a thickness of the connection portion.

3. The connector according to claim 1, wherein
a surface of the top wall portion is an inclination/bend corresponding surface that is inclined or bent along a shape of a connection surface of the corresponding connection object member that is to be connected.

4. The connector according to claim 1, wherein
the conductive portions protrude from the retaining portion in the thickness direction.

5. The connector according to claim 1, wherein
a surface of the retaining portion is an inclination/bend corresponding surface that is inclined or bent along shapes of connection surfaces of the connection object members that are to be connected.

6. The connector according to claim 1, wherein
the electrode planes on a same surface side of the plurality of conductive portions are disposed on an inclination or a bent surface that continuously extends along an inclination or a bent surface shape of a connection surface of the corresponding connection object member.

7. A connector that is compressed between connection object members and that conductively connects the connection object members to each other, the connector comprising:
a plurality of conductive portions, each conductive portion having conductors arranged in a thickness direction and having two electrode planes each in contact with the corresponding connection object member; and
a retaining portion that retains the conductive portion, wherein
each of the electrode planes having an inclination/bend surface corresponding to a shape of a connection surface of the corresponding connection object member in a free state from the connection object members.

8. The connector according to claim 7, wherein
the conductive portions protrude from the retaining portion in the thickness direction.

9. The connector according to claim 7, wherein
a surface of the retaining portion is an inclination/bend corresponding surface that is inclined or bent along shapes of connection surfaces of the connection object members that are to be connected.

10. The connector according to claim 7, wherein
the electrode planes on a same surface side of the plurality of conductive portions are disposed on an inclination or a bent surface that continuously extends along an inclination or a bent surface shape of a connection surface of the corresponding connection object member.

* * * * *